United States Patent [19]

Horinishi

[11] 4,344,020

[45] Aug. 10, 1982

[54] ELECTRONIC FLASH DEVICE CAPABLE OF AUTOMATIC FLASH DURATION ADJUSTMENT

[75] Inventor: Katsumi Horinishi, Hashimoto, Japan

[73] Assignee: West Electric Co., Ltd., Osaka, Japan

[21] Appl. No.: 184,043

[22] Filed: Sep. 4, 1980

[30] Foreign Application Priority Data

Sep. 4, 1979 [JP] Japan ..... 54-113730
Sep. 4, 1979 [JP] Japan ..... 54-113731

[51] Int. Cl.[3] ..... H05B 41/34
[52] U.S. Cl. ..... 315/241 P; 315/151
[58] Field of Search ..... 315/151, 159, 241 P; 354/145

[56] References Cited

U.S. PATENT DOCUMENTS 3,896,333 7/1975 Nakamura ..... 315/151
3,998,534 12/1976 Schulze et al. ..... 354/145 X
4,155,031 5/1979 Kuraishi ..... 315/241 P

*Primary Examiner*—Eugene R. La Roche
*Attorney, Agent, or Firm*—Burgess, Ryan and Wayne

[57] ABSTRACT

In an electronic flash device, in order to control the discharge through a flash lamp for converting the energy stored on a main discharge capacitor into light; that is, in order to control the flash duration, a series circuit consisting of a main switching element, a commutation capacitor for commutating the main switching element after the flash lamp has been lighted and an auxiliary switching element is connected in series to the main discharge capacitor. When the flash lamp is triggered or lighted or when the main switching element is commutated, the commutation capacitor is charged through the series circuit.

3 Claims, 2 Drawing Figures

ELECTRONIC FLASH DEVICE CAPABLE OF AUTOMATIC FLASH DURATION ADJUSTMENT

BACKGROUND OF THE INVENTION

The present invention relates to generally an electronic flash device and more particularly an electronic flash device capable of automatic flash duration adjustment and successive flashes.

Electronic flash device capable of successive flashes have been widely used with motor-driven cameras and in photographing a subject moving at a high velocity. There has been an increasing demand for electronic flashes capable of successive flashes at higher frequencies.

The prior art electronic flash devices capable of successive flashes is of the so-called series controlled type in which the flash duration is suitably adjusted by controlling a switching element connected in series to a flash lamp in response to a distance to subject, a film speed or an aperture. The frequency of the successive flashes with such flash devices will be discussed below.

In the series controlled type, in response to the exposure factors described above, the switching element connected in series to the flash lamp is controlled by a flash duration control circuit consisting of a commutation circuit consisting of a commutation capacitor, an auxiliary switching element and other associated circuit elements and a brightness sensor with a light sensor. Therefore, the frequency of successive flashes is in general dependent upon a frequency at which the flash duration control circuit can control the switching element. When this switching element is switched into the conduction state, the flash lamp is lighted but when it is switched into the nonconduction state, the flash lamp is turned off. Obviously, it is more difficult to drive the switching element into the nonconduction state than to switch it into the conduction state. As a result, some interval of time is needed after switching element has been switched into the nonconduction state before it can be switched again into the conduction state; that is, before the next flash is ready.

The discharge of the commutation capacitor causes the switching element to switch into the nonconduction state. As a result, the frequency of successive flashes is determined by an interval of time between the charging and recharging of the commutation capacitor; that is, by the charging time constant of the commutation capacitor. It follows, therefore, that the straightforward method for increasing the flash frequency is to select a short time constant. However, in the prior art electronic flash devices, a fixed charging resistance is connected in the circuit for charging the commutation capacitor without exception. It is possible, therefore, to make the charging time constant very short by selecting a charging resistor having a low resistance or a commutation capacitor having a low capacitance, but this gives rise to the problem that failures in switching the switching element into the nonconduction state or in extinguishing or deionizing the flash lamp tend to occur at high frequencies. As a result, the charging time constant cannot be made shorter than some limit. Thus, it has been so far impossible to attain the flash frequency of less than 0.1 sec. by mere efforts for making the charging time constant short without causing the failures or malfunctions described above.

SUMMARY OF THE INVENTION

The present invention was made to overcome the above and other problems encountered in the prior art electronic flash devices and has for its object to provide an electronic flash device in which the commutator capacitor charging circuit, which is established after a flash lamp has been lighted, consists of a switching element whose resistance is almost nil so that the charging time constant can be made very short, whereby the high-frequency flashes can be produced without causing any erratic operation.

Briefly stated, to the above and other ends, according to the present invention, a series circuit consisting of a main switching element for controlling the discharge through a flash lamp by condenser action, a commutation capacitor for commutating the main switching element after the flash lamp has been lighted and an auxiliary switching element is connected in series to the main discharge capacitor. When the flash lamp is triggered or lighted or when the main switching element is commutated, the commutation capacitor is charged or recharged through the above-described series circuit, whereby the next flash becomes ready.

The above and other objects, effects and features of the present invention will become more apparent from the following description of preferred embodiments thereof taken in conjunction with the accompanying drawings, in which same reference numerals are used to designate similar parts.

DESCRIPTION OF THE PREFERRED EMBODIMENTS

Figure 1:
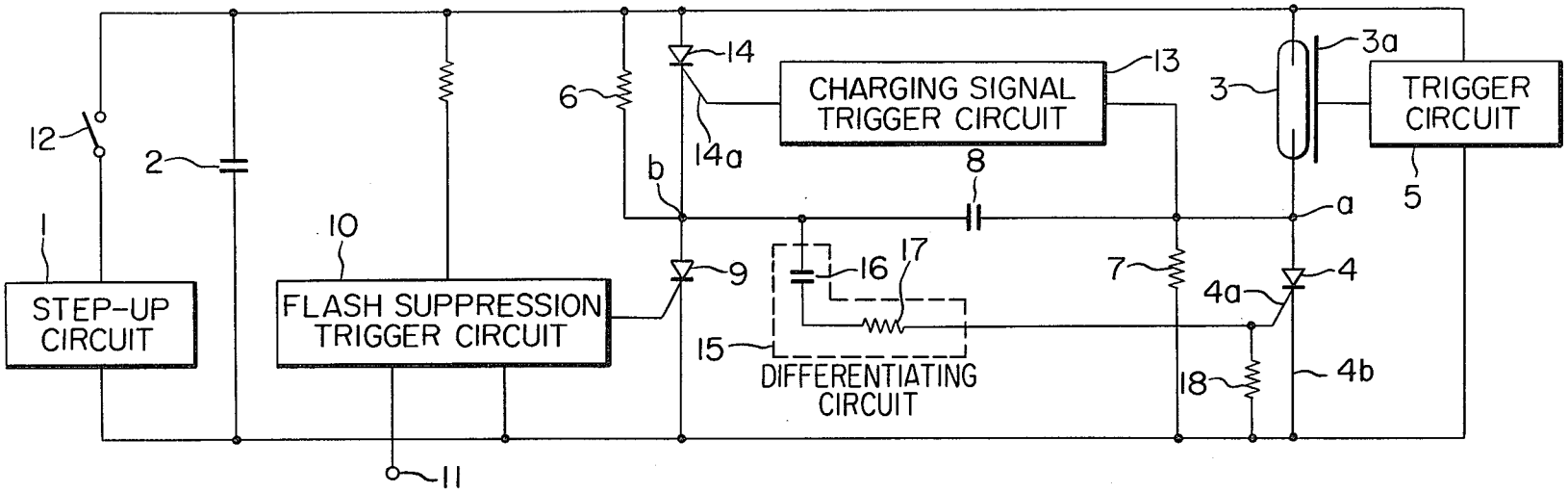
FIG. 1 is an electric circuit diagram of a first embodiment of an electronic flash device capable of automatic brightness control.

First Embodiment, FIG. 1

In FIG. 1, reference numeral 1 denotes a step-up circuit such as a DC-DC converter; 2, a main discharge capacitor; 3, a flash lamp; 4, a main switching element which consists of a silicon-controlled element and is connected in series to the flash lamp 3; 5, a trigger circuit; 6 and 7, fixed resistors; 8, a commutation capacitor; 9, a first auxiliary switching element; 10, a flash suppression trigger circuit for controlling the first auxiliary switching element 9; 11, a flash suppression signal input terminal; 12, a power switch; 13, a charging signal trigger circuit; 14, a second auxiliary switching element; 15, a differentiating circuit consisting of a capacitor 16 and a resistor 17; and 18, a gate resistor for the main switching element 4.

When the power switch 12 is closed, not only the main discharge capacitor 2 but also the commutation capacitor 8 are charged through the resistors 6 and 7 with the voltage supplied from the voltage step-up circuit 1. When the trigger circuit is actuated in response to the shutter release operation of a camera (not shown) after these capacitors 2 and 8 have been charged, the trigger signal is generated and applied to the trigger electrode 3*a* on the flash lamp 3 and subsequently the voltage at the junction a rises momentarily. As a result, the voltage at the junction b rises very high through the commutation capacitor 8, so that the trigger signal is applied from the differentiating circuit 15 to the gate 4*a* of the main switching element 4 so that the latter is enabled or switched into the conduction state. Then the flash lamp 3 is brilliantly lighted by the discharge of the main discharge capacitor 2.

When the flash interruption signal corresponding to the distance to subject is applied from the input terminal 11 to the trigger circuit 10, the trigger signal is generated and applied to the first auxiliary switching element 9, so that the latter is enabled. Then the charge on the commutation capacitor 8 is discharged so that the positive voltage is applied to the cathode 4*b* of the main switching element 4. As a result, the main switching element 4 is turned into the nonconduction state so that the flash lamp 3 is turned off.

When the commutation capacitor 8 is discharged, the current flows through the flash lamp 3, the junction a, the junction b and the first auxiliary switching element 9. As a result, the plate of the commutation capacitor 8 on the side of the junction a is positively charged while the plate on the side of the junction b is negatively charged and the trigger circuit 13 is actuated by the positive voltage at the junction a.

The trigger circuit 13 generates the trigger signal which in turn is applied to the gate 14*a* of the second auxiliary switching element 14 so that the latter is turned into the condition state.

Upon conduction of the switching element 14, the potential at the junction b rises instantly so that the differentiating circuit 15 generates the gate signal which in turn is applied to the gate 4*a* of the main switching element 4. As a result, the series circuit consisting of the second auxiliary switching element 14, the commutation capacitor 8 and the main switching element 4 is connected across the main discharge capacitor 2 or the voltage step-up circuit 1 so that the plate of the commutation capacitor 8 on the side of the junction b is instantly charged positively, whereby the next flash is ready. Briefly stated, the commutation capacitor 8 is immediately brought to the state for turning off the main switching element 4 by the discharge through the first auxiliary switching element 9.

In other words, according to the present invention, two switching elements are turned into the conduction state almost simultaneously when the commutation capacitor 8 is discharged for the control of the flash duration and the charging for the next flash is started through these switching elements. Except the case of the first charging, the resistance of the circuit for charging the commutation capacitor 8 is almost nil, so that, as compared with the prior art flash devices, the charging time constant can be made extremely short in the case of successive flashes.

The tests conducted by the inventor show that the time between successive flashes is 0.07 seconds. It follows, therefore, that with the electronic flash device of the present invention, a subject moving at an extremely high speed can be photographed at a high frequency.

The commutation capacitor 8 can be charged and discharged at a higher frequency, but the conventional flash lamps have a finite deionization or extinguishing time so that it will be impossible to set the time constant less than the above frequency of 0.07 sec. In other words, according to the present invention, the frequency of successive flashes can be solely dependent upon the deionization or extinguishing time of the flash lamp used; that is, the present invention has reached the technical limits of the electronic flash devices using the conventional flash lamps.

Two switching elements which constitute the charging circuit for the commutation capacitor 8 after the first flash will not be turned into the conduction state unless the charge stored on it by the first charging has been discharged. As a result, the above described erratic operations will not result so that it suffices only to select a commutation capacitor having such a capacitance that no failure in commutation will occur.

The differentiating circuit 15 consisting of the capacitor 16 and the resistor 17 has a double function of transmitting the variation in voltage at the junction a to the main switching element 4 when the flash lamp 3 is triggered, thereby causing the main switching element 4 to conduct in synchronism with the triggering of the flash lamp 3 and of reverse biasing the gate 4*a* of the main switching element 4 in the case of the discharge of the commutation capacitor 8, thereby turning off the main switching element 4. In addition, as described previously, it has also a very important function of, in the case of the charging of the commutation capacitor 8, transmitting the voltage rise at the junction b due to the conduction of the second auxiliary switching element 14 to the main switching element 4 so that the commutation capacitor 8 is charged through the main switching element 4.

Figure 2:
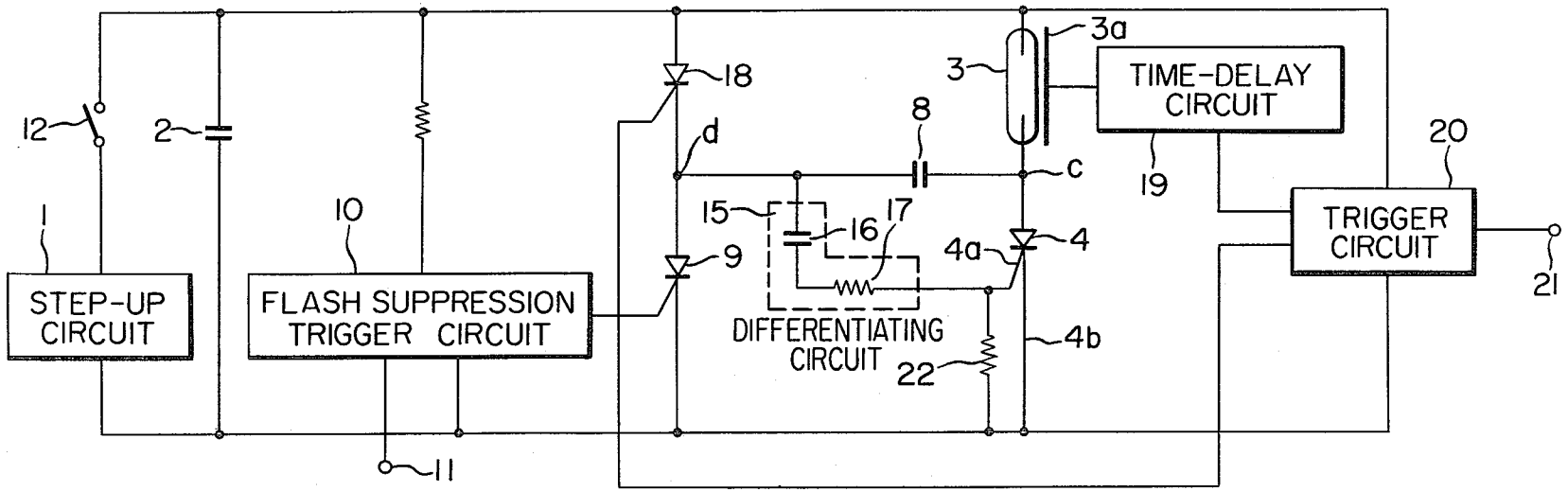
FIG. 2 is an electric circuit diagram of a second embodiment of the present invention.

Second Embodiment, FIG. 2

When the on-off switch 12 is closed, the main discharge capacitor 2 is charged with the voltage supplied from the voltage step-up circuit 1.

When the shutter of the camera (not shown) is depressed, the flash start signal is applied to an input terminal 21 of a trigger circuit 20 which in turn generates the trigger signals which in turn are applied to a second switching element 18 and a time-delay circuit 19. As a result, the second auxiliary switching element is turned onto the conduction state so that the voltage at the junction d rises instantly and is transmitted through the differentiating circuit 15 to the gate 4*a* of the main switching element 4, thereby the latter is turned into the conduction state. As a result, the current flows through the second auxiliary switching element 18, the commutation capacitor 8 and the main switching element 4 so that the electrode on the side of the junction d of the commutation capacitor 8 is positively charged. Thus the flash lamp 3 is ready to flash.

The trigger signal from the circuit 20 is transmitted through the time-delay circuit 19 to the trigger electrode 3'. Therefore, it follows that the flash lamp 3 is triggered after a predetermined time interval after the main switching element 4 has been turned into the conduction state and subsequently the commutation capacitor 8 has been charged. When the flash lamp 3 is triggered, the voltage at the junction c rises instantly. This voltage rise is also transmitted through the differentiating circuit 15 to the gate 4*a* of the main switching element 4, whereby the latter is turned into the conduction state (sic). As a result, the flash lamp 3 is lighted.

Thereafter the flash interruption signal corresponding to a subject is applied through the input terminal 11 to the trigger circuit 10 which in turn generates the trigger signal which in turn is applied to the first auxiliary switching element 9 to turn it into the conduction state. As a result, the commutation capacitor 8 is discharged so that the positive voltage is applied to the cathode 4*b* of the main switching element 4 and the gate 4*a* is reverse biased through a gate resistor 22. As a result, the main switching element 4 is turned into the nonconduction state so that the flash lamp 3 is turned off.

With this electronic flash device, the high-frequency flashes are possible with the time interval between the flashes of 0.07 sec. and because of the charging time constant the recharging at a higher frequency is possible as described previously with reference to the first embodiment.

As described above, the commutation capacitor 8 has a very small time constant so that, regardless of the first flash of the successive flashes, the charging of the commutation capacitor 8 for controlling the flash duration is accomplished between the time when the flash start signal is applied to the trigger circuit 20 and the time when the flash lamp 3 is triggered. In other words, unless the flash lamp 3 is to be lighted, the commutation capacitor 8 will not be charged so that the energy will not be wasted and consequently a long service life of the commutation capacitor 8 can be ensured.

The time-delay circuit 19 sets the interval of time from time when the flash start signal is applied to the trigger circuit 20 to the time when the flash lamp 3 is triggered. With a time delay of 50 micro seconds, the commutation capacitor 8 can be completely charged and there will be no adverse effects on the flash exposures.

What is claimed is:

1. An electronic flash device capable of automatic flash duration adjustment comprising a flash lamp for converting the energy stored on a main capacitor into light, a main switching element connected in series to said flash lamp and having a gate terminal, a gate circuit connected to said gate terminal on said main switching element for controlling the conduction of said main switching element, a commutation capacitor for commutating said main switching element so as to interrupt the discharge through said flash lamp after said flash lamp has been lighted, a first auxiliary switching element connected to said commutation capacitor and adapted to be switched into the conduction state in response to the triggering signal produced when said flash lamp is lighted, thereby discharging said commutation capacitor so as to commutate said main switching element, a time-delay circuit interconnected between a trigger gate for triggering said flash lamp and a trigger electrode of said flash lamp, and a second auxiliary switching element connected in series to said main discharge capacitor through said commutation capacitor and said main switching element and adapted to be switched into the conduction state in response to the trigger signal from said trigger circuit, thereby switching said main switching element into the conduction state so as to recharge said commutation capacitor.

2. An electronic flash device capable of automatic flash duration adjustment as defined in claim 1 wherein said gate circuit is a differentiating circuit which causes said main switching element to switch into the conduction state in response to the variation in voltage due to the conduction of said second auxiliary switching element.

3. An electronic flash device capable of automatic flash duration adjustment, comprising:

a flash lamp for converting the energy stored in a main discharge capacitor into light;

a main switching element connected in series to said flash lamp and provided with a gate terminal;

a commutation capacitor for commutating said main switching element, thereby interrupting the discharge through said flash lamp after it has been lighted;

a first auxiliary switching element which is connected in series to said commutation capacitor so that when said first auxiliary switching element is turned on, said commutation capacitor is so charged as to commutate said main switching element;

a second auxiliary switching element which is interconnected between said first auxiliary switching element and said main discharge capacitor and which has a gate terminal;

a trigger circuit which, when said first auxiliary switching element is turned on so that said commutation capacitor is discharged, applies a gate voltage to said gate terminal of said second auxiliary switching element, thereby turning said second auxiliary switching element on; and a differentiating circuit adapted to switch said main switching element into the conduction state in response to the variations in voltage caused by the triggering of said flash lamp and the conduction of said second auxiliary switching element.

* * * * *